US008991606B2

(12) United States Patent
Ortenzi et al.

(10) Patent No.: US 8,991,606 B2
(45) Date of Patent: Mar. 31, 2015

(54) PHARMACUTICAL PRODUCT BLISTER PACK LOCKABLE WITHIN SECONDARY PACKAGING

(75) Inventors: Vernon D. Ortenzi, Burlington, KY (US); Robert J. Ziemba, Cincinnati, OH (US)

(73) Assignee: Mallinckrodt LLC, Hazelwood, MO (US)

( * ) Notice: Subject to any disclaimer, the term of this patent is extended or adjusted under 35 U.S.C. 154(b) by 80 days.

(21) Appl. No.: 13/215,864

(22) Filed: Aug. 23, 2011

(65) Prior Publication Data

US 2012/0061396 A1 Mar. 15, 2012

Related U.S. Application Data

(60) Provisional application No. 61/376,552, filed on Aug. 24, 2010.

(51) Int. Cl.
*B65D 25/04* (2006.01)
*B65D 83/04* (2006.01)

(52) U.S. Cl.
CPC ..... *B65D 83/0463* (2013.01); *B65D 2215/00* (2013.01)
USPC ..... 206/531; 206/1.5; 206/536; 206/538; 229/125.125

(58) Field of Classification Search
USPC ..... 206/536, 538, 1.5, 804, 531, 528, 539, 206/828, 807; 229/122, 125.125
See application file for complete search history.

(56) References Cited

U.S. PATENT DOCUMENTS

| | | | | |
|---|---|---|---|---|
| 6,460,693 | B1 * | 10/2002 | Harrold | 206/1.5 |
| 6,863,175 | B2 * | 3/2005 | Gelardi | 206/1.5 |
| 7,540,383 | B2 * | 6/2009 | Huffer et al. | 206/530 |
| 2005/0133397 | A1 * | 6/2005 | Mehling | 206/459.5 |

* cited by examiner

*Primary Examiner* — Anthony Stashick
*Assistant Examiner* — Robert Poon
(74) *Attorney, Agent, or Firm* — James L. Johnson; Marsh Fischmann & Breyfogle LLP

(57) ABSTRACT

A pharmaceutical product supply in the form of a container (e.g., secondary packaging) and a pharmaceutical product receiver (e.g., primary packaging) is disclosed. The pharmaceutical product receiver may include a plurality of pockets or receptacles, and may be disposed within the container. Pharmaceutical product may be enclosed within one or more of these receptacles. The pharmaceutical product receiver may be locked to at least some degree within the container to facilitate disposal of the pharmaceutical product supply, for instance at a time when some of the pharmaceutical product may have been removed from the pharmaceutical product receiver but prior to utilizing all of the pharmaceutical product originally provided with the pharmaceutical product receiver.

10 Claims, 4 Drawing Sheets

PHARMACUTICAL PRODUCT BLISTER PACK LOCKABLE WITHIN SECONDARY PACKAGING

CROSS-REFERENCE TO RELATED APPLICATIONS

This patent application is a non-provisional patent application of and claims priority to U.S. Provisional Patent Application Ser. No. 61/376,552, that is entitled "PHARMACEUTICAL PRODUCT BLISTER PACK LOCKABLE WITHIN SECONDARY PACKAGING," and that was filed on Aug. 24, 2010.

FIELD OF THE INVENTION

The present invention generally relates to the field of packaging for pharmaceutical products such as pills, capsules, and the like and, more particularly, to packaging arrangements that facilitate the disposal of pharmaceutical products (e.g., to reduce the potential of illicit usage of unused pharmaceutical product).

BACKGROUND

Abuse, misuse, and overdose of pharmaceutical products (e.g., pain management drugs) are serious health concerns that affect many people on a daily basis all over the world. For instance, diversion and subsequent misuse or abuse may occur when a patient gets a prescription for a pharmaceutical product and does not use all of the pharmaceutical product for whatever reason (e.g., a doctor may prescribe a pharmaceutical product for a patient and advise the patient to take the pharmaceutical product on an "as needed" basis; a patient may be advised to use an entire prescribed amount of pharmaceutical product, but may unilaterally decide to discontinue use of the pharmaceutical product as one or more symptoms disappear). In any case, remaining pharmaceutical product may be ultimately acquired by an individual other than for whom the pharmaceutical product was originally prescribed (e.g., transferred by the original patient to another individual, such as family member or friend; stolen).

While unused pharmaceutical product may be disposed of in the trash, this may not be viewed by some as a secure method of disposal. In some states, "take back" programs have been instituted, allowing users to request shipping materials in order to ship used or unused pharmaceutical product (e.g., patches, pills, capsules) to a certified disposal company. These programs are costly and require several actions by the patient at multiple times.

SUMMARY

The present invention embodies a pharmaceutical product supply. This pharmaceutical product supply includes a container, a pharmaceutical product receiver, and pharmaceutical product. More specifically, the pharmaceutical product receiver includes a plurality of pockets or receptacles, and may be disposed within the container. Pharmaceutical product is enclosed within at least one of these receptacles (e.g., pharmaceutical product may be contained with each of the receptacles). Generally, the pharmaceutical product receiver may be locked to at least some degree within the container to facilitate disposal of the pharmaceutical product supply, for instance at a time when some of the pharmaceutical product may have been removed from the pharmaceutical product receiver but prior to utilizing all of the pharmaceutical product originally provided with the pharmaceutical product receiver.

A first aspect of the present invention is embodied by a pharmaceutical product supply of the above-noted type, but where a mechanical lock is provided between the container and the pharmaceutical product receiver. At a time when the pharmaceutical product receiver is positioned within the container, having the mechanical lock being disposed in an activated state will at least restrain this pharmaceutical product receiver from being removed from the container (e.g., locking the pharmaceutical product receiver within the container). Moreover, the mechanical lock may be configured so as to be permanently retained in its activated (e.g., locking or locked) state.

A number of feature refinements and additional features are applicable to the first aspect of the present invention. These feature refinements and additional features may be used individually or in any combination. As such, each of the following features that will be discussed may be, but are not required to be, used with any other feature or combination of features of the first aspect of the present invention. The following discussion pertains to this first aspect, up to the start of the discussion of a second aspect of the present invention.

The mechanical lock may be manually activated, may be activated on an exterior of the container, or both. For instance, a user may engage one or more buttons or the like located on an exterior of the container to dispose the mechanical lock in its activated state. In one embodiment, the mechanical lock utilizes a projection/aperture arrangement (e.g., a dead-bolt type lock). The projection may be associated with one of the container and the pharmaceutical product receiver, while the aperture may be associated with the other of the container and the pharmaceutical product receiver. In one embodiment, the projection is associated with the container (e.g., integrally formed therewith, such that there is no joint between the projection and an adjoining portion of the container), while the aperture is associated with the pharmaceutical product receiver (e.g., a hole of any appropriate configuration that extends completely through a tray of a blister card). Generally, disposing at least part of the projection at least partially within the aperture may dispose the mechanical lock in its activated state (e.g., the projection may indeed extend completely through the aperture when the mechanical lock is in its activated state).

The projection may be of any appropriate size, shape, configuration, and/or type. Representative projections include without limitation a detent, a locking pin, a locking tab, a locking post, or the like. The projection may be a movable structure, for instance to dispose or change the projection from an unlocked configuration to a locked configuration. Disposing the projection in its locked configuration may place the mechanical lock in its activated state. In one embodiment, the projection is unable to return from its locked configuration to its unlocked configuration (e.g., once the projection has been disposed in its locked configuration, it may be precluded from returning to its unlocked configuration). Although this may be provided by the manner in which the projection is integrated by, for instance, the container as will be discussed below, a latch may be disposed within the interior of the container to restrain the projection from moving from its locked configuration back to its unlocked configuration. Such a latch may be integrally formed with the container (e.g., of a one-piece construction, such that there is no joint of any kind between the latch and the container). The latch may be integrated with the container, and may be engageable with the pharmaceutical product receiver. When in a latched configuration, the latch may prevent the projection from returning to an unlocked configuration.

Any appropriate motion may be utilized to change the projection from its unlocked configuration to its locked configuration. The projection may be characterized as being movably interconnected with the container. Any appropriate movable interconnection may be utilized, for instance a hinge between the container and the projection (e.g., a living hinge). One representative movable interconnection between the projection and the container is a pivotal interconnection.

The projection in the noted projection/aperture arrangement for the mechanical lock may also be in the form of a stationary structure. The projection may extend from the container (e.g., within an interior thereof) and may remain in a stationary position relative to at least part of the container (e.g., the surface from which the projection extends). As such, the pharmaceutical product receiver may include the aperture. At least one actuator may be utilized to move the pharmaceutical product receiver relative to the container to dispose the mechanical lock in an inactive state. In one embodiment, one or more actuators of the container are engaged or activated to exert a lifting force on the pharmaceutical product receiver that directs the projection out of the aperture. Thereafter, the pharmaceutical product receiver may be removed from the interior of the container, for instance by withdrawing the pharmaceutical product receiver out through an open end of the container.

Any appropriate number of actuators of the above-noted type may be utilized. One or more actuators may be incorporated at any appropriate location on the container and in any appropriate manner. A pair of actuators may be disposed on opposing sides or side panels of the container, and furthermore may be disposed in opposing relation (e.g., directly across from one another; such that a user exerts collinear/opposing forces on a pair of actuators). In any case, when the pharmaceutical product receiver is appropriately positioned within the container and without engaging the actuator(s), the projection of the container may extend at least partially within the aperture of the pharmaceutical product receiver to dispose the mechanical lock in its activated state. As such, the pharmaceutical product receiver should not be able to be removed from the container in the intended manner.

The pharmaceutical product receiver may be repeatedly removed from and inserted back into the container in the above-described manner. When disposal of the pharmaceutical product supply is desired, at least one of these actuators may be disabled and/or at least partially removed from the container (e.g., utilizing a score or the like between the actuator and the remainder of the container; a "tear away" configuration for such an actuator) such that the actuator(s) may no longer be used to dispose the mechanical lock in an inactive state. As such, the mechanical lock should then remain in an activated state to reduce the potential of the pharmaceutical product receiver being removed from the container.

The aperture of the noted projection/aperture arrangement may be associated with the pharmaceutical product receiver as noted. The pharmaceutical product receiver may be in the form of a blister card, and the aperture may be incorporated by a tray for the blister card. Although the aperture may extend completely through the pharmaceutical product receiver, the aperture could be in the form of a concave depression or the like on an exterior surface of the pharmaceutical product receiver (or whatever structure incorporates the aperture in the projection/aperture arrangement for the mechanical lock).

One configuration of the pharmaceutical product supply uses a locking member (e.g., a locking tab, flap, or the like) that is movably interconnected with the container, along with an aperture that extends through the pharmaceutical product receiver. The interaction between this locking member and the aperture may define the activated state for the mechanical lock.

The locking member may be movably interconnected with the container in any appropriate manner (e.g., pivotally), for instance using a hinge (e.g., a living hinge). The locking member may be located on an exterior of the container when in an unlocked configuration, for instance such that it is coplanar with a panel of the container that incorporates the locking member. In any case, the locking member may extend within an interior of the container when it is disposed in its locked configuration (e.g., by a user pressing inwardly (in a direction of the interior of the container) on the locking member). This movement of the locking member into its locked configuration may direct the locking member into/through the aperture of the pharmaceutical product receiver to dispose the mechanical lock in its activated state.

Once the locking member has been changed from its unlocked configuration to its locked configuration, the pharmaceutical product supply may be configured such that the locking member is thereafter unable to return to its unlocked configuration. This should reduce the potential of the pharmaceutical product receiver being able to be removed from the interior of the container. In one embodiment, the container includes a latch that restrains the locking member from moving from its locked configuration back to its unlocked configuration. Such a latch may be disposed within the interior of the container, may be integrally-formed with the container (e.g., such that there is no joint between the locking member and an adjoining portion of the container), or both. The latch may be integrated with the container, and may be engageable with the pharmaceutical product receiver. When in a latched configuration, the latch may prevent the latching member from returning to an unlocked configuration.

The manner in which the locking member is movably interconnected with the container may keep the locking member from moving back to its unlocked configuration. Consider the case where the locking member moves within a first dimension when changing from its unlocked configuration to its locked configuration, and where the pharmaceutical product receiver moves relative to the container in a second dimension when the pharmaceutical product receiver is removed from the container. Having the first and second dimensions be different from one another may preclude the locking member from returning from its locked configuration back to its unlocked configuration. If the pharmaceutical product receiver is characterized as moving in a longitudinal dimension when being withdrawn from the container (e.g., through an open end thereof), the locking member may be characterized as moving in a lateral dimension when being changed from its unlocked configuration to its locked configuration (e.g., pivoting in a side-to-side fashion in relation to the structure of the container). Stated another way, the locking member may be movably integrated with the container such that when the pharmaceutical product receiver is disposed within the container and when the locking member is disposed within the aperture, exerting a force on the pharmaceutical product receiver in an attempt to withdraw the pharmaceutical product receiver out from the container may exert a force on the locking member, but this force is not exerted in a direction that would tend to move the locking member back toward its unlocked configuration.

Another configuration of the pharmaceutical product supply uses at least one release actuator. Activating each such release actuator allows the pharmaceutical product receiver to be removed from the container (e.g., for a dosing event). One or more of the release actuators may be disabled and/or at least partially removed from the container (e.g., utilizing a tear-away configuration) so as to maintain the mechanical lock in its activated state when the pharmaceutical product receiver is appropriately positioned within the container. As such, a common component (e.g., at least one release actuator) may be utilized in selectively retaining the pharmaceutical product receiver within the container, and may also be utilized to more permanently lock the pharmaceutical product receiver within the container. In this arrangement, the mechanical lock may be in the form of a projection that extends within an interior of the container and into/through an aperture formed in the pharmaceutical product receiver.

A second aspect of the present invention is embodied by a pharmaceutical product supply of the type addressed at the introduction of this Summary, but where the container includes a movable locking member and where the pharmaceutical product receiver includes an aperture. The movable locking member may be disposed in a locked configuration where the locking member extends at least into the aperture of the pharmaceutical product receiver (e.g., to provide resistance to removal of the pharmaceutical product receiver out from the interior of the container).

A number of feature refinements and additional features are applicable to the second aspect of the present invention. These feature refinements and additional features may be used individually or in any combination. As such, each of the following features that will be discussed may be, but are not required to be, used with any other feature or combination of features of the second aspect of the present invention. The following discussion pertains to this second aspect, up to the start of the discussion on a third aspect of the present invention.

The locking member may be movably interconnected with the container in any appropriate manner, for instance using a hinge of any appropriate type (e.g., a living hinge). The locking member may also undergo any appropriate motion or combination of motions when being disposed in its locked configuration. In one embodiment, the locking member is pivoted relative to a remainder of the container when being disposed in its locked configuration.

The locking member may be movable from an unlocked configuration to its locked configuration. In its unlocked configuration, the locking member may define a portion of the perimeter of the container (e.g., by being disposed coplanar with a panel of the container that incorporates the locking member). Stated another way, the locking member may be characterized as being disposed on an exterior of the container when in its unlocked configuration, and may be characterized as extending within an interior of the container when disposed in its locked configuration. In one embodiment and once the locking member has been disposed in its locked configuration, the locking member may be unable to return to its unlocked configuration (e.g., a mechanical lock incorporating the locking member and aperture may be configured so as to be permanently retained in an activated or locked state). This may be realized in the manner addressed above in relation to the first aspect (e.g., by the manner in which the locking member is incorporated by the container, by incorporating an interior latch, or both).

A third aspect of the present invention is embodied by a pharmaceutical product supply of the type addressed at the introduction of this Summary, but where the container includes a first locking member and at least one release actuator, and where the pharmaceutical product receiver includes a second locking member. The first and second locking members may collectively define a mechanical lock. Activating one or more release actuators disposes this mechanical lock in an inactive state. Disabling and/or at least partially removing at least one release actuator eliminates an ability of such a release actuator to dispose the mechanical lock in its inactive state.

A number of feature refinements and additional features are applicable to the third aspect of the present is invention. These feature refinements and additional features may be used individually or in any combination. As such, each of the following features that will be discussed may be, but are not required to be, used with any other feature or combination of features of the third aspect of the present invention. The following discussion pertains to at least to this third aspect.

When the mechanical lock is in its inactive state, the pharmaceutical product receiver may be removed from the container, for instance by being withdrawn out from an interior of the container through an open end of the container. When the pharmaceutical product receiver is appropriately positioned within the container, and further when at least one release actuator has been disabled and/or at least partially removed, the mechanical lock is maintained in an active state (e.g., the mechanical lock may be configured so as to be permanently retained in an active, activated, or locked state). Having the mechanical lock in an active state reduces the potential that the pharmaceutical product receiver may be removed from the container in the intended manner.

The first locking member associated with the container may be in the form of the projection discussed above in relation to the first aspect. The second locking member associated with the pharmaceutical product receiver may be in the form of an aperture that extends at least partially through the pharmaceutical product receiver and as discussed above in relation to the first aspect, and thereby encompassing extending completely through the pharmaceutical product receiver (e.g., through a tray of a blister card).

The pharmaceutical product receiver may move relative to the container to dispose the mechanical lock in its inactive state in response to activating at least one release actuator. In one embodiment, each release actuator includes a cam or an angled surface. Actuating at least one release actuator causes an engaged portion of the pharmaceutical product receiver (e.g., an edge thereof) to advance along the cam or angled surface. This induces a relative motion between the pharmaceutical product receiver and the container to disengage the first and second locking members (e.g., by lifting the pharmaceutical product receiver such that the projection of the container no longer extends within the aperture of the pharmaceutical product receiver). A motion of the at least one release actuator in one direction may produce motion of the pharmaceutical product receiver in a different direction.

Any feature of any of the various aspects of the present invention that is intended to be limited to a "singular" context or the like will be clearly set forth herein by terms such as "only," "single," "limited to," or the like. Merely introducing a feature in accordance with commonly accepted antecedent basis practice does not limit the corresponding feature to the singular (e.g., indicating that a pharmaceutical product supply includes "a pharmaceutical product receiver" alone does not mean that the pharmaceutical product supply includes only a single pharmaceutical product receiver). Moreover, any failure to use phrases such as "at least one" also does not limit the corresponding feature to the singular (e.g., indicating that pharmaceutical product supply includes "a pharmaceutical product receiver" alone does not mean that the pharmaceutical product supply includes only a single pharmaceutical product receiver). Use of the phrase "at least generally" or the like in relation to a particular feature encompasses the corresponding characteristic and insubstantial variations thereof (e.g., indicating that a panel is at least generally flat encompasses the panel being flat). Finally, a reference of a feature in conjunction with the phrase "in one embodiment" does not limit the use of the feature to a single embodiment.

The container utilized by the various aspects may be characterized as "secondary packaging." The container may be of any appropriate size, shape, configuration, and/or type. Moreover, the container may be formed from any appropriate material or combination of materials. Although the container could include an openable cover, the container may simply include an open end through which the pharmaceutical product receiver may be directed to withdraw the pharmaceutical product receiver from within the container (e.g., for a dosing event), as well as to insert the pharmaceutical product receiver back into the container (e.g., for storage).

The pharmaceutical product receiver utilized by the various aspects may be characterized as "primary packaging." The pharmaceutical product receiver may be in the form of a blister card or blister packaging. Scoring or perforations could be provided between each adjacent pair of receptacles of the blister card. As such, a single "blister pack" could be removed from the remainder of the blister card and for any appropriate reason. However, the blister card could be configured so as to retain the collection of receptacles in a connected state or condition (whether or not pharmaceutical product has been removed from one or more of the receptacles).

The above-noted blister card may be in the form of a pre-formed tray or the like having a number of receptacles or pockets. Any appropriate number of receptacles may be incorporated by the blister card. The various receptacles may be disposed in any appropriate arrangement, for instance in the form of a matrix having a certain number of rows and a certain number of columns at the time the blister card is dispensed to a patient or other end user.

An appropriate covering may be positioned over each receptacle in the above-noted blister card tray to enclose the associated pharmaceutical product. Such a covering may be in the form of a film, a foil, paper, a sheet-like material, or the like. In any case, this covering may be secured to the tray in any appropriate manner to seal or enclose pharmaceutical product within each of the various receptacles (e.g., a single pharmaceutical product dose). In one embodiment, this covering is rupturable over each of the individual receptacles of the tray to gain access to the pharmaceutical product within the receptacle. Rupturing the covering that overlies one receptacle should not affect the covering over any of the other receptacles (e.g., pharmaceutical product in these other receptacles should remain enclosed with the tray by the covering). In another embodiment, the covering may be "peeled" away from at least part of the tray to expose pharmaceutical product in at least one receptacle. Although a single covering could be positioned over each of the various receptacles, individual coverings could be positioned over each individual receptacle.

A "pharmaceutical product" as used herein may generally define any material or substance used in the course of a medical treatment, medical diagnosis, therapy, or the provision of any other appropriate medical care. In one embodiment, each pharmaceutical product is in the form of a pill (e.g., a tablet or capsule).

A pharmaceutical product within the receptacles of the pharmaceutical product receiver may be in any appropriate form, in any appropriate dose, and of any appropriate type. A pharmaceutical product encompasses both a single-dose configuration (e.g., a single pill) and a multiple dose configuration (e.g., a plurality of pills). Pharmaceutical product may be in any appropriate form such as (but not limited to) pills, tablets, chewables, capsules, or the like. Further, a "pharmaceutical product" may refer to or include any "drug" as defined in Title 21 of the United States Code, Section 321(g)(1).

DETAILED DESCRIPTION

Figure 1A:
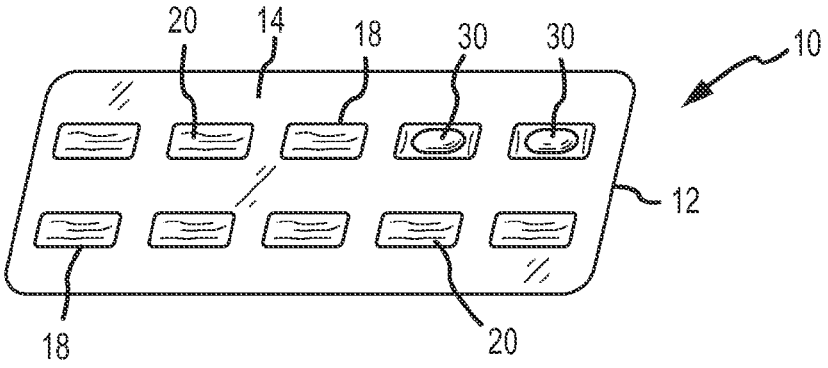
FIG. 1A is a top view of a representative blister card that may be utilized by a pharmaceutical product supply.
Figure 1B:
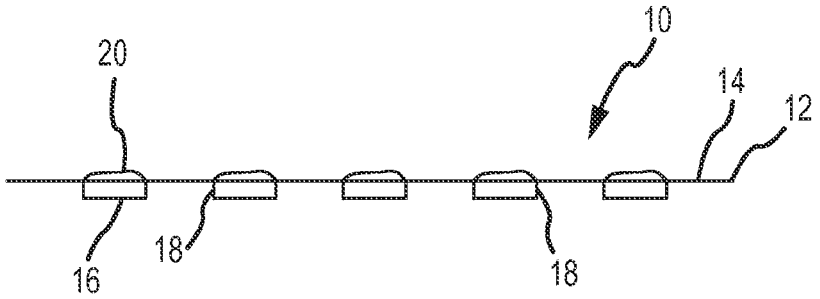
FIG. 1B is a side view of the blister card of FIG. 1A.

A representative blister card or pack is shown in FIGS. 1A, 1B, and 10, is identified by reference numeral 10, and may be used in each of the embodiments of FIGS. 2A-C and 3A-D addressed below. The blister card 10 includes a tray 12 (e.g., a pre-formed structure, for instance plastic) having a plurality of receptacles 18. Any number of receptacles 18 may be utilized by the tray 12, and these receptacles 18 may be disposed in any appropriate arrangement. In the illustrated embodiment, there are two rows and five columns of receptacles 18. Any number of rows and columns may be utilized. Any arrangement of receptacles 18 may be utilized by the blister card 10.

Figure 1C:
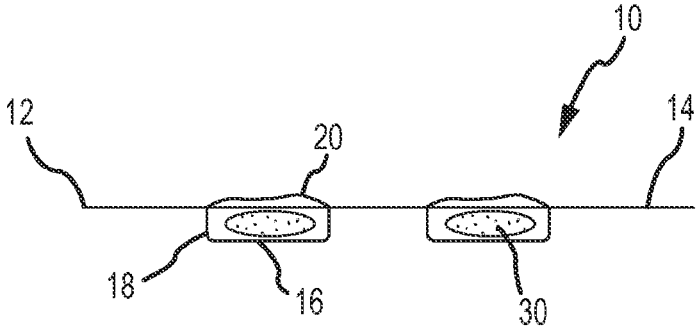
FIG. 1C is an end view of the blister card of FIG. 1A.

Pharmaceutical product 30 may be disposed in each receptacle 18 of the blister card 10, and as such the blister card 10 may be referred to as "primary packaging" for the pharmaceutical product 30. A covering 20 is disposed over each receptacle 18 to enclose the corresponding pharmaceutical product 30 (the covering 20 being "puckered" in FIGS. 1B and 1C to distinguish the same from the tray 12, although the covering 20 could be at least substantially coplanar with the upper surface 14 of the tray 12). Although a single covering could extend over an entirety of an upper surface 14 of the tray 12 (or at least over each of the various receptacles 18), in the illustrated embodiment each receptacle 18 has its own individual covering 20. Any covering 20 for the blister card 10 may be in the form of a film, foil, paper, a sheet-like material, or the like. Generally, pharmaceutical product 30 may be removed from a given receptacle 18 by pushing on a lower surface 16 of the tray 12 (more specifically a receptacle 18), which in turn may push the pharmaceutical product 30 against the associated covering 20 with a sufficient force so as to rupture the covering 20. The covering 20 could also be "peeled" away from the tray 12 to gain access to pharmaceutical product 30 within a given receptacle 18. Any way of gaining access to the pharmaceutical product 30 in a given receptacle 18, enclosed by a covering 20, may be implemented by the blister card 10.

Various embodiments of secondary packaging for blister cards at least generally of the above-noted type will now be described. Collectively, the secondary packaging and any blister card disposed therein may be referred to as a "pharmaceutical product supply." In any case, the embodiments that will be described include various locking arrangements that facilitate disposal of the secondary packaging with one or more blister cards retained therein. Although each of these embodiments include only a single blister card within secondary packaging, the locking arrangements should work to lock multiple blister cards within the secondary packaging.

Figure 2A:
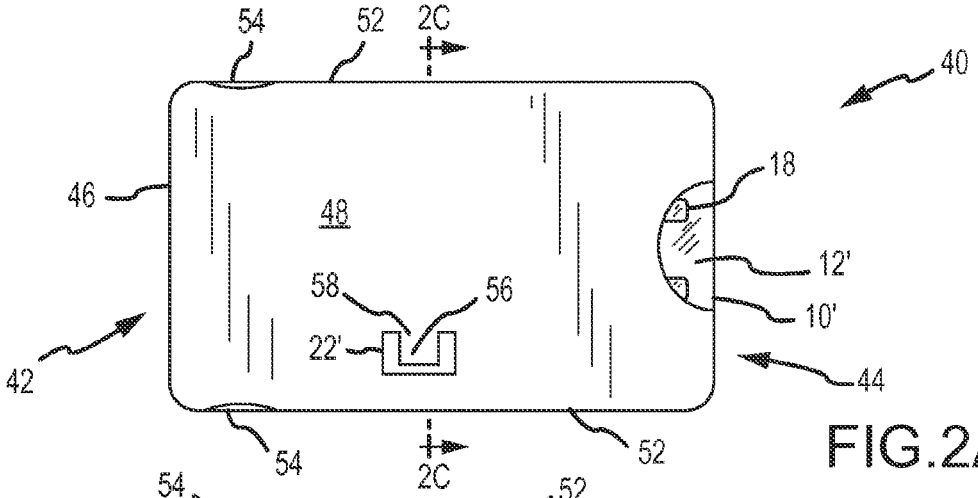
FIG. 2A is a top view of one embodiment of a pharmaceutical product supply that utilizes secondary packaging for a blister card, and that incorporates one locking arrangement to facilitate disposal.
Figure 2B:
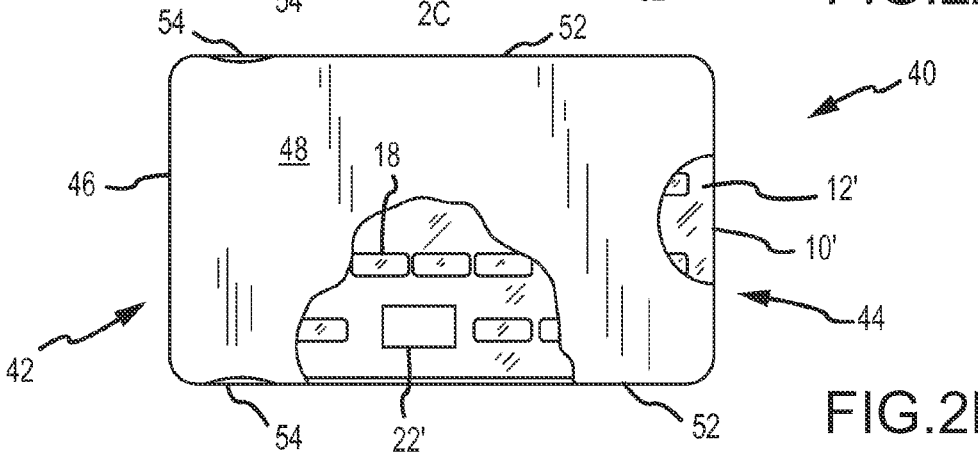
FIG. 2B is a partial cutaway view of the pharmaceutical product supply of FIG. 2A, and that illustrates a locking slot formed in the blister card.
Figure 2C:
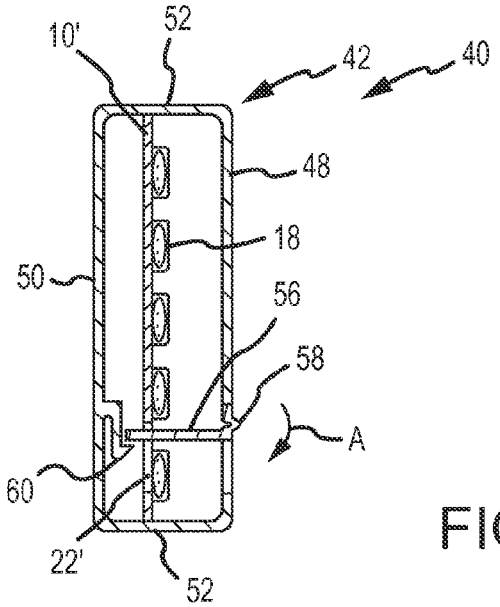
FIG. 2C is a cross-sectional view of the pharmaceutical product supply of FIG. 2A, taken along line C-C.

One embodiment of a pharmaceutical product supply is shown in FIGS. 2A-C and is identified by reference numeral 40. Generally, the pharmaceutical product supply 40 is a combination of a container or secondary packaging 42, along with at least one blister card 10' that may be stored within and removed from the container 42. The blister card 10' shown in FIGS. 2A-C is a variation of the blister card 10 discussed above in relation to FIGS. 1A-C, and is thereby identified by a "single prime" designation. Corresponding components between the blister card 10 of FIGS. 1A-C and the blister card 10' of FIGS. 2A-C are identified by common reference numerals. Those corresponding components that differ in at least some respect are identified by the above-noted "single prime" designation. In this regard, the primary difference between the blister card 10 of FIGS. 1A-C and the blister card 10' of FIGS. 2A-C is the inclusion of a slot 22' that extends completely through the tray 12' at an appropriate location. This slot 22' may be used to lock the blister card 10' within the container 42 to facilitate disposal of the pharmaceutical product supply 40 in a manner that will be discussed in more detail below. The blister card 10' also has five rows of receptacles 18 (versus two rows in the embodiment of FIGS. 1A-C), although again any number/arrangement of receptacles 18 may be utilized by the blister card 10'.

The container 42 may be formed from any appropriate material or combination of materials, and may be of any appropriate configuration. In the illustrated embodiment, the container 42 includes an end panel 46 and an oppositely disposed open end 44. The blister card 10' may be directed through this open end 44 to dispose the blister card 10' within the container 42 for storage, as well as to at least partially remove the blister card 10' from within the container 42 (e.g., to gain access to one or more receptacles 18, so as to be able to remove pharmaceutical product 30 from the blister card 10' in the above-noted manner). An openable cover or flap (not shown) could be provided to selectively expose/block the open end 44.

The container 42 for the pharmaceutical product supply 40 further includes an upper panel 48, an oppositely disposed bottom panel 50, and a pair of side panels 52. A pair of release tabs 54 may be incorporated by the side panels 52 to allow the blister card 10' to be removed from within the container 42. For instance, the release tabs 54 may be pressed toward one another to disable an internal retention mechanism of any appropriate type (not shown) such that the blister card 10' may be pulled out of the container 42 through its open end 44. That is, the container 42 may incorporate an appropriate mechanism to releasably retain the blister card 10' within the container 42. Activation of the release tabs 54 may temporarily disable or deactivate such a retention mechanism (e.g., by changing the same from a locked configuration to an unlocked configuration). Simply repositioning the blister card 10' back within the container 42 may "reactivate" this retention mechanism. Although the release tabs 54 and the noted retention mechanism may be utilized, such may be eliminated in at least some cases. Moreover, although the release tabs 54 are shown as being disposed in opposing relation, such need not be the case in all instances.

The container 42 further includes what may be characterized as a locking tab, latch member, or detent 56. Generally, this locking tab 56 may be moved from an unlocked configuration to a locked configuration. Disposing the locking tab 56 in its locked configuration disposes the locking tab 56 within the slot 22' of the blister card 10' when it is appropriately positioned within the container 42 (e.g., FIG. 20). This inhibits the blister card 10' from thereafter being removed from the container 42 in the intended manner (e.g., by pulling the blister card 10' out through the open end 44 of the container 42, for instance after activating the release tabs 54). In one embodiment, once the locking tab 56 is disposed in its locked configuration, it thereafter may not be moved back to its unlocked configuration (e.g., a mechanical lock defined by an interaction of the locking tab 56 and the slot 22' may be configured so as to be permanently retained in an active, activated, or locked/locking state). As such the locking tab 56 may be moved into its locked configuration to facilitate disposal of the pharmaceutical product supply 40 (e.g., by providing a locking arrangement that retains the blister card 10' within the container 42). It should be appreciated that the described locking arrangement does not preclude rupturing the container 42 in some fashion to gain access to the blister card 10' stored therein.

The locking tab 56 may be incorporated by the container 42 in any appropriate manner to provide the above-noted function. In the illustrated embodiment, the locking tab 56 is formed as part of the upper panel 48 of the container 42. An appropriate hinge 58 (e.g., a living hinge) may allow the locking tab 56 to be moved relative to the remainder of the upper panel 48 to move the locking tab 56 from its unlocked configuration of FIG. 2A (e.g., where the locking tab 56 may be coplanar with the remainder of the upper panel 48) to its locked configuration of FIG. 2C (e.g., where the locking tab 56 now extends into the interior of the container 42). The locking tab 56 may pivot relative to the remainder of the upper panel 48 in the direction indicated by the arrow A in FIG. 2C when moving from its unlocked configuration to its locked configuration. The locking tab 56 may be disposed in one orientation when in its unlocked configuration, and may be disposed in a different orientation when in its locked configuration.

FIG. 2C shows the locking tab 56 of the container 42 extending through the slot 22' of the blister card 10'—a locked configuration for the pharmaceutical product supply 40. The interaction between the locking tab 56 of the container 42 and the slot 22' of the blister card 10' creates a physical interference between the blister card 10' and container 42. In the illustrated embodiment and when changing from its unlocked configuration to its locked configuration, the locking tab 56 moves in a dimension that is different than a dimension in which the blister card 10' is pulled to attempt to remove the blister card 10' from the container 42. The locking tab 56 may be characterized as pivoting within a plane that is orthogonal to the plane in which the blister card 10' is moved to withdraw the blister card 10' out of the container 42. As shown in FIG. 2C, the locking tab 56 may pivot about the hinge 58 in the direction illustrated by the arrow A to move from its unlocked configuration to its locked configuration (e.g., by pivoting within a plane that extends between the two side panels 52; by moving parallel to the page in the view shown in FIG. 2C). In contrast, the blister card 10' would have to be moved into/out of the page in the view shown in FIG. 2C to withdraw the blister card 10' out of the container 42. Stated another way with regard how the locking tab 56 may be integrated to provide its locking function, the locking tab 56 may be movably integrated with the container 42 such that forces exerted on the locking tab 56, when the locking tab 56 is in its locked configuration and when an attempt is made to pull the blister card 10' out of the container 42, do not move the locking tab 56 back to its unlocked configuration. In the view shown in FIG. 2C, the blister card 10' would be moved orthogonally to the page when attempting to remove the blister card 10' from the container 42. This would not exert a force on the locking tab 56 that would tend to pivot the locking tab 56 about its hinge 58 (e.g., in the direction of the arrow A, or in the opposite direction).

Although the interaction between the locking tab 56 of the container 42 and the slot 22' of the blister card 10' may be sufficient to "lock" the blister card 10' within the container 42, one or more additional retention features or the like may be utilized by the pharmaceutical product supply 40. For instance, a latch member 60 may be incorporated within the interior of the container 42 to impede a movement of the locking tab 56 that would dispose the same back into its unlocked configuration (e.g., FIG. 2A) after having been disposed in its locked configuration (e.g., FIG. 2C). The latch member 60 may be integrally formed with the container 42 (e.g., of one-piece construction, such that there is no joint of any kind between the latch member 60 and the container 42), and in the illustrated embodiment the latch member 60 extends from the bottom panel 50. The head of the latch member 60 is spaced from the bottom panel 50 and is movable relative to the bottom panel 50. In this regard, the locking tab 56 could deflect the latch member 60 to move its head in the direction of the bottom panel 50 as the locking tab 56 is moved from its unlocked configuration to its locked configuration (e.g., by the free end of the locking tab 56 engaging an angled surface or cam on the head of the latch member 60). After the free end of the locking tab 56 clears the head of the latch member 60, the resiliency and/or elasticity of the latch member 60 may move the head of the latch member 60 back toward its undeflected position (e.g., FIG. 2C). The head of the latch member 60 should then impede the ability to pivot the locking tab 56 past the latch member 60 in the direction and to an extent that it returns to its unlocked configuration (FIG. 2A).

Another embodiment of a pharmaceutical product supply is shown in FIGS. 3A-D and is identified by reference numeral 70. Generally, the pharmaceutical product supply 70 is a combination of a container or secondary packaging 72, along with at least one blister card 10" that may be stored within and removed from the container 72. The blister card 10" shown in FIGS. 3A-D is a variation of the blister card 10 discussed above in relation to FIGS. 1A-C, and is thereby identified by a "double prime" designation. Corresponding components between the blister card 10 of FIGS. 1A-C and the blister card 10" of FIGS. 3A-D are identified by common reference numerals. Those corresponding components that differ in at least some respect are identified by the above-noted "double prime" designation. In this regard, the primary difference between the blister card 10 of FIGS. 1A-C and the blister card 10" of FIGS. 2A-C is the inclusion of an aperture or slot 22" that extends completely through the tray 12" at an appropriate location. This slot 22" may be used to lock the blister card 10''' within the container 72 to facilitate disposal of the pharmaceutical product supply 70 in a manner that will be discussed in more detail below. As the slot 22" need not be of the same size and/or configuration as the slot 22' discussed above in relation to the embodiment of FIGS. 2A-C, a double prime designation is used to identify the same in FIGS. 3A-D.

The container 72 may be formed from any appropriate material or combination of materials, and may be of any appropriate configuration. In the illustrated embodiment, the container 72 includes an end panel 76 and an oppositely disposed open end 74. The blister card 10" may be directed through this open end 74 to dispose the blister card 10" within the container 72 for storage, as well as to at least partially remove the blister card 10" from within the container 72 (e.g., to gain access to one or more receptacles 18, so as to be able to remove pharmaceutical product 30 from the blister card 10" in the above-noted manner). An openable cover or flap (not shown) could be provided to selectively expose/block the open end 74.

The container 72 for the pharmaceutical product supply 70 further includes an upper panel 78, an oppositely disposed bottom panel 80, and a pair of side panels 82. A pair of release tabs 84 may be incorporated by the side panels 82 to allow the blister card 10" to be selectively removed from the container 72. When the blister card 10" is disposed within the container 72, and while the release tabs 84 are disengaged or deactivated, the blister card 10" is at least somewhat locked within the container 72—the blister card 10" should not be able to be withdrawn from the container 72 through its open end 74. Activating the release tabs 84, however, does allow the blister card 10" to be able to be withdrawn from the container 72 through its open end 74.

The release tabs 84 provide an additional function in the case of the pharmaceutical product supply 70—preparing the pharmaceutical product supply 74 for disposal. Removing and/or disabling one or more of the release tabs 84, with the blister card 10" being appropriately positioned within the container 72, should inhibit the blister card 10" from thereafter being removed from the container 72 in the intended manner (e.g., by attempting to pull the blister card 10" out through the open end 74 of the container 72). That is, the blister card 10" is at least somewhat locked within the container 72. However, it should be appreciated that the described locking arrangement does not preclude rupturing the container 72 in some fashion to gain access to the blister card 10" stored therein.

Figure 3A:
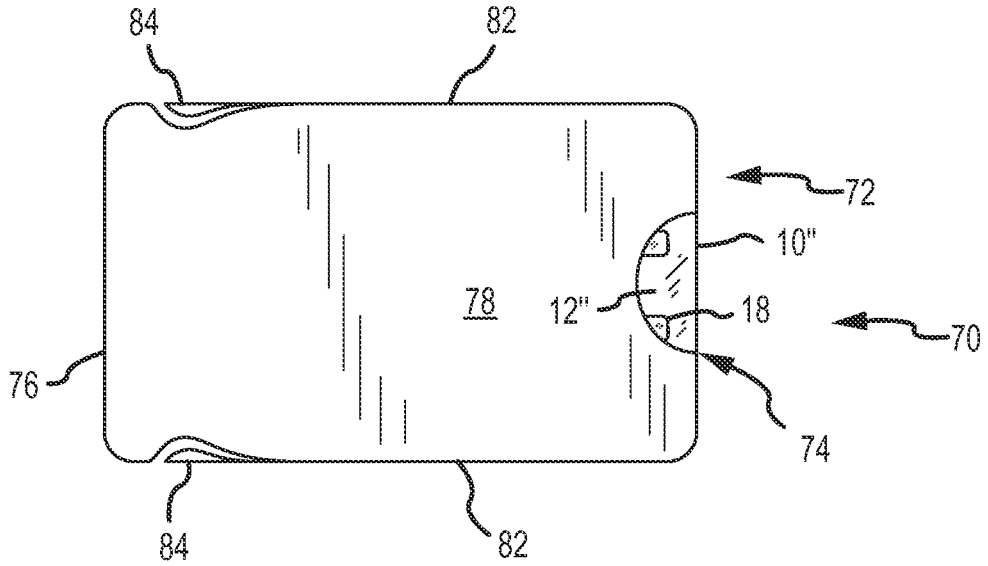
FIG. 3A is a top view of one embodiment of a pharmaceutical product supply that utilizes secondary packaging for a blister card, and that incorporates another locking arrangement to facilitate disposal.
Figure 3B:
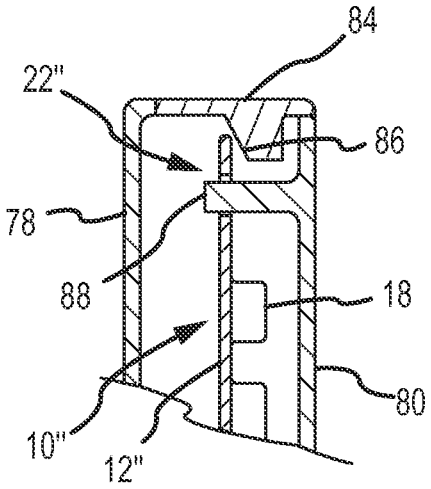
FIG. 3B is a cross-sectional view to illustrate one of the release tabs utilized by the secondary packaging and the locking of the blister card within the secondary packaging.
Figure 3C:
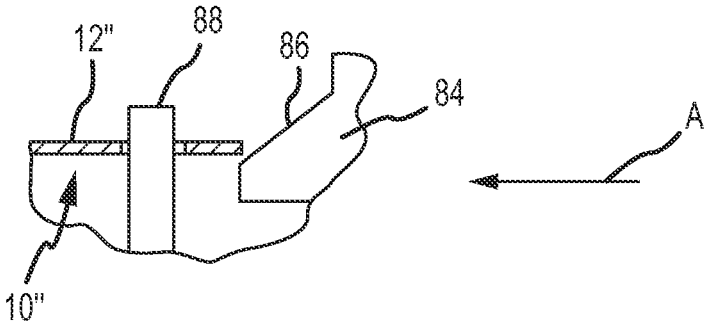
FIG. 3C is an enlarged view of the locking arrangement between the blister card and the secondary packaging shown in FIG. 3B, where the blister card is locked within the secondary packaging.
Figure 3D:
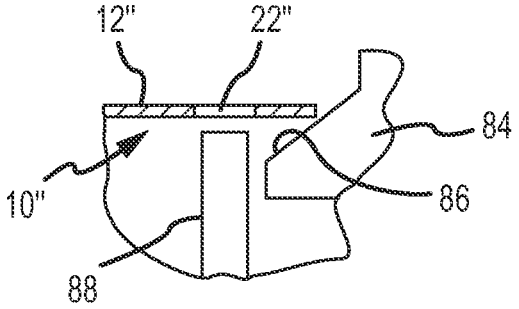
FIG. 3D is an enlarged view of the locking arrangement between the blister card and the secondary packaging shown in FIG. 3A, but after the release tab(s) has been activated to unlock the blister card from the secondary packaging.

FIGS. 3B-D are each directed to illustrating the above-noted locking arrangement. Initially, the container 72 further includes what may be characterized as a locking post, latch member, or detent 88. More generally, the locking post 88 is in the form of a projection. The locking post 88 may extend from one of the upper panel 78 and lower panel 80, toward, but not to, the other of the upper panel 78 and lower panel 80. In the locked configuration shown in FIGS. 3B and 3C, the blister card 10" is positioned within the interior of the container 72 such that the locking post 88 of the container 72 extends completely through the slot 22" of the blister card 10". This again impedes the ability to withdraw the blister card 10" out from the container 72 through its open end 74.

Activating the release tabs 84 moves the blister card 10" relative to the container 72 in a manner/direction such that the blister card 10" may be withdrawn from the container 72 through its open end 74. Referring now to FIGS. 3C and 3D, one of the release tabs 84 is shown and may be moved in the direction of the arrow A in FIG. 3C to position the blister card 10" for withdrawal from the container 72. In the illustrated embodiment, the release tabs 84 are moved at least generally toward each other to release the blister card 10" from the container 72. However, an activating motion of a given release tab 84 may be described as moving the same at least generally in the direction of the opposite side panel 82 of the container 72.

Each release tabs 84 includes a cam or angled surface 86 that may interface with the blister card 10" (e.g., the tray 12") to "lift" the blister card 10" off of the locking post 88 of the container 72. Moving the release tab 84 shown in FIG. 3C in the direction of the arrow A causes an edge of the blister card 10" to "ride up" the cam 86, which lifts the blister card 10" up off the locking post 88 to the position illustrated in FIG. 3D. Generally, motion of the release tab 84 in one dimension may produce motion of the blister card 10" in a different dimension. Once the blister card 10" is disposed in the position illustrated in FIG. 3D (the blister card 10" being shown in slightly spaced relation to the cam 86 for clarity—the card 10" would typically be in contact with the cam 86 at this time), it may be removed from the container 72 through its open end 74.

The blister card 10" may be reinserted back into the container 72, and once it is in an appropriate position the blister card 10" should "seat" back on the locking post 88 of the container 72 (e.g., such that the locking post 88 once again extends up through the slot 22"). The blister card 10" may be repeatedly removed from and inserted back into the container 72 in the above-noted manner. When it is time to dispose of the pharmaceutical product supply 70 and as noted above, one or both of the release tabs 84 may be at least partially removed from the container 72 and/or otherwise be disabled. If at least one release tab 84 is removed/disabled and if the blister card 10" is positioned therein such that the locking post 88 of the container 72 extends through the slot 22" of the blister card 10", there should be at least some resistance to removal of the blister card 10" out through the open end 74 of the container 72. If at least one release tab 84 is removed/disabled and if the blister card 10" is thereafter positioned within the container 72 such that the locking post 88 of the container 72 extends through the slot 22" of the blister card 10", there should also be at least some resistance to removal of the blister card 10" out through the open end 74 of the container 72 (e.g., a mechanical lock defined by an interaction of the locking post 84 and the slot 22" may be configured so as to be permanently retained in an active, activated, or locked/locking state). That is, the same mechanism that is used to releasably retain the blister card 10" within the secondary packaging 72 (namely the release tabs 84), is used to place the pharmaceutical product supply 70 in an enhanced configuration for disposal (e.g., removing and/or disabling one or more of the release tabs 84).

Based upon the foregoing, a number of mechanical locking arrangements are disclosed for secondary packaging that includes one or more blister cards. One or more locking components may be integrated into the structure of the secondary packaging (e.g., integral construction, such that there is no joint between a locking member and the remainder of the secondary packaging). The locking arrangement may be activated by a simple manual operation. Again, these locking arrangements are intended to reduce the potential of a blister card being removed from its secondary packaging in the intended manner. These locking arrangements do not address each and every way that once could envisioned regarding attempting to gain access to pharmaceutical product stored within secondary packaging.

The foregoing description of the present invention has been presented for purposes of illustration and description. Furthermore, the description is not intended to limit the invention to the form disclosed herein. Consequently, variations and modifications commensurate with the above teachings, and skill and knowledge of the relevant art, are within the scope of the present invention. The embodiments described hereinabove are further intended to explain best modes known of practicing the invention and to enable others skilled in the art to utilize the invention in such, or other embodiments and with various modifications required by the particular application(s) or use(s) of the present invention. It is intended that the appended claims be construed to include alternative embodiments to the extent permitted by the prior art.

What is claimed:

1. A pharmaceutical product supply, comprising:

a container comprising first and second panels disposed in opposing relation, a movable locking member, and a latch member that is disposed within an interior of said container, wherein said first panel comprises said locking member, wherein said latch member extends from said second panel and comprises a head that is spaced from said second panel, wherein said locking member is movable from a first position to a second position, and wherein there is no joint between said latch member and said second panel;

a pharmaceutical product receiver disposable within and removable from said container while said locking member is in said first position, wherein said pharmaceutical product receiver comprises an aperture and a plurality of receptacles; and pharmaceutical product enclosed within at least one of said plurality of receptacles of said pharmaceutical product receiver, wherein moving said locking member from said first position toward said second position directs said locking member through said aperture of said pharmaceutical product receiver and into engagement with said head of said latch member to resiliently deflect said latch member to move said head toward said second panel, and wherein when said locking member reaches said second position said head of said latching member resiliently moves back away from said second panel and remains engaged with said locking member to permanently retain said locking member in said second position and lock said pharmaceutical product receiver within said container.

2. The pharmaceutical product supply of claim 1, wherein said locking member is movable relative to said container from an unlocked configuration to a locked configuration.

3. The pharmaceutical product supply of claim 2, wherein said locking member is unable to return from said locked configuration to said unlocked configuration.

4. The pharmaceutical product supply of claim 2, wherein said latch member retains said locking member in said locked configuration.

5. The pharmaceutical product supply of claim 2, wherein said locking member is on an exterior of said container when in said unlocked configuration, and wherein said locking member extends within an interior of said container when disposed in said locked configuration.

6. The pharmaceutical product supply of claim 2, wherein said locking member moves within a first dimension when changing from said unlocked configuration to said locked configuration, wherein said pharmaceutical product receiver moves relative to said container in a second dimension when said pharmaceutical product receiver is removed from said container, and wherein said first and second dimensions are different.

7. The pharmaceutical product supply of claim 1, wherein said container further comprises a hinge between said locking member and an adjacent portion of said first panel of said container, wherein said locking member is movable about said hinge from said first position to said second position.

8. The pharmaceutical product supply of claim 7, wherein said container further comprises a first end panel that extends between said first and second panels, and an open end that is opposite of said first end panel, and wherein said hinge is orientated parallel to a direction that said first end panel and said open end of said container are spaced from one another.

9. The pharmaceutical product supply of claim 7, wherein said container further comprises an open end, and wherein said hinge is orientated parallel to a direction that said pharmaceutical product receiver moves when being withdrawn out of said container through said open end of said container.

10. The pharmaceutical product supply of claim 1, wherein said locking member is coplanar with a remainder of said first panel when said locking member is in said first position.

* * * * *